United States Patent [19]

Luyk

[11] Patent Number: 4,838,181

[45] Date of Patent: Jun. 13, 1989

[54] TABLE LEG COUPLING ASSEMBLY

[75] Inventor: Harley E. Luyk, Hudsonville, Mich.

[73] Assignee: L.H.L. Incorporated, Grand Rapids, Mich.

[21] Appl. No.: 208,880

[22] Filed: Jun. 20, 1988

[51] Int. Cl.[4] ..... A47B 3/06

[52] U.S. Cl. ..... 108/156; 108/131; 108/143; 248/188

[58] Field of Search ..... 312/195, 198; 108/156, 108/59, 64, 143, 131; 182/36; 248/188, 188.1

[56] References Cited

U.S. PATENT DOCUMENTS

| | | | |
|---|---|---|---|
| 1,627,454 | 5/1927 | Phalon | 108/129 |
| 2,217,914 | 10/1940 | McMahan | 248/188 |
| 3,123,022 | 3/1964 | Huddleston | 108/129 |
| 3,126,189 | 3/1964 | Van Syoc, Sr. | 248/188 |
| 3,159,438 | 12/1964 | Carlson | 248/188 X |
| 3,245,364 | 4/1966 | Weinberg | 108/131 |
| 3,312,432 | 4/1967 | Pfeiffer et al. | 248/188.6 |
| 3,396,928 | 8/1968 | Lay | 108/129 |
| 3,510,096 | 5/1970 | Mutchnik et al. | 248/188 |
| 3,845,728 | 11/1974 | Piretti | 108/131 |
| 3,960,352 | 1/1976 | Plattner | 248/188 |
| 4,144,822 | 3/1979 | Roberts et al. | 108/129 |

*Primary Examiner*—James T. McCall

*Attorney, Agent, or Firm*—Price, Heneveld, Cooper, DeWitt & Litton

[57] ABSTRACT

A coupling assembly is provided to adjustably mount the table legs to a table top. The coupling assembly includes a pivotally mounted body having a pair of angularly offset recesses which are adapted to cooperate with a spring biased lever in order to securely lock the table leg in either its extended, supporting position or its collapsed storage position. Further, the body is provided with an elongate guideway along which the table leg may be laterally adjusted.

13 Claims, 2 Drawing Sheets

TABLE LEG COUPLING ASSEMBLY

BACKGROUND OF THE INVENTION

The present invention pertains to coupling assemblies, and in particular to a coupling assembly specially suited for movably joining a table leg to a table top.

Tables having adjustable legs have been known in the prior art for many years. Typically, the adjustment capacity has comprised a coupling assembly which permits collapsible legs to enhance the table's portability and reduce storage space requirements. One important aspect of such a coupling assembly is to provide a locking arrangement which will securely hold the legs alternatively in either the extended, supporting position or the collapsed, storage position. A second aspect is to utilize an efficient construction which is not only economical to manufacture, but also avoids undue complexity. Thirdly, it is important to fashion the assembly to facilitate easy accessibility and operation for a user. However, the attempts to achieve incorporation of all three beneficial aspects into one coupling assembly have been less than satisfactory.

Moreover, coupling assemblies which have provided an adjustment capability beyond the mere collapsing of the legs have in large part not been developed. An example of one such construction is illustrated in U.S. Pat. No. 3,123,022 issued Mar. 3, 1964 to Huddleston, and entitled COLLAPSIBLE AND EXTENSION TABLE. However, this structure fails to provide a durable and secure locking arrangement, a versatile adjustment capacity, or any accommodation permitting contraction or reduction of the space required for the legs than would ordinarily be needed.

SUMMARY OF THE INVENTION

In accordance with the present invention, a unique table leg coupling assembly is provided which not only securely and efficiently locks the leg in its extended and collapsed positions, but also provides therefor an additional lateral adjustment capacity.

The coupling assembly of the present invention includes a pivotally mounted body attached to the underside of a table top and coupled to the table leg. More specifically, the body includes a pair of angularly spaced recesses adapted to cooperate with a spring biased lever to efficiently and securely lock the leg in its extended and collapsed positions. The assembly utilizes a minimum number of durable and securely locking parts to thereby enhance the economical manufacture of the coupling assembly along with its longevity. Also, the assembly is oriented and constructed for easy accessibility and operation.

In a second aspect of the invention, the body of the assembly is shaped as a generally elongate member having a longitudinal channel adapted to mount the leg through a cooperating lock means. The novel arrangement permits an infinite lateral adjustment capability for the leg not heretofore realized. Moreover, the lock means is operable in a secure and easy manner to facilitate a quick adjustment thereof when desired.

A table utilizing the coupling assemblies of the present invention possesses a greatly enhanced portability and universality. Firstly, the portability is greatly enhanced by providing a long lasting and easily operable locking mechanism which facilitates collapse and extension of each leg. Moreover, by providing an infinite lateral adjustment capacity, the table legs may be specially arranged to suit a particular floor space arrangement to thereby enable the table top to be placed, at all times, precisely where desired, regardless of the placement of floor registers, electrical outlets or other furniture and household items which may pose obstructions for the legs of the table.

These and other objects, advantages and features of the present invention will be more fully understood and appreciated by reference to the written specification and appended drawings.

DETAILED DESCRIPTION OF THE PREFERRED EMBODIMENTS

In the preferred embodiment, a table leg 10 is movably secured to a table top 12 through the use of a coupling assembly 14. Coupling assembly 14 permits a multiple of adjustments of table leg 10, which include a pivotal movement between extended and collapsed positions and an infinite lateral adjustment thereof.

Figure 1:
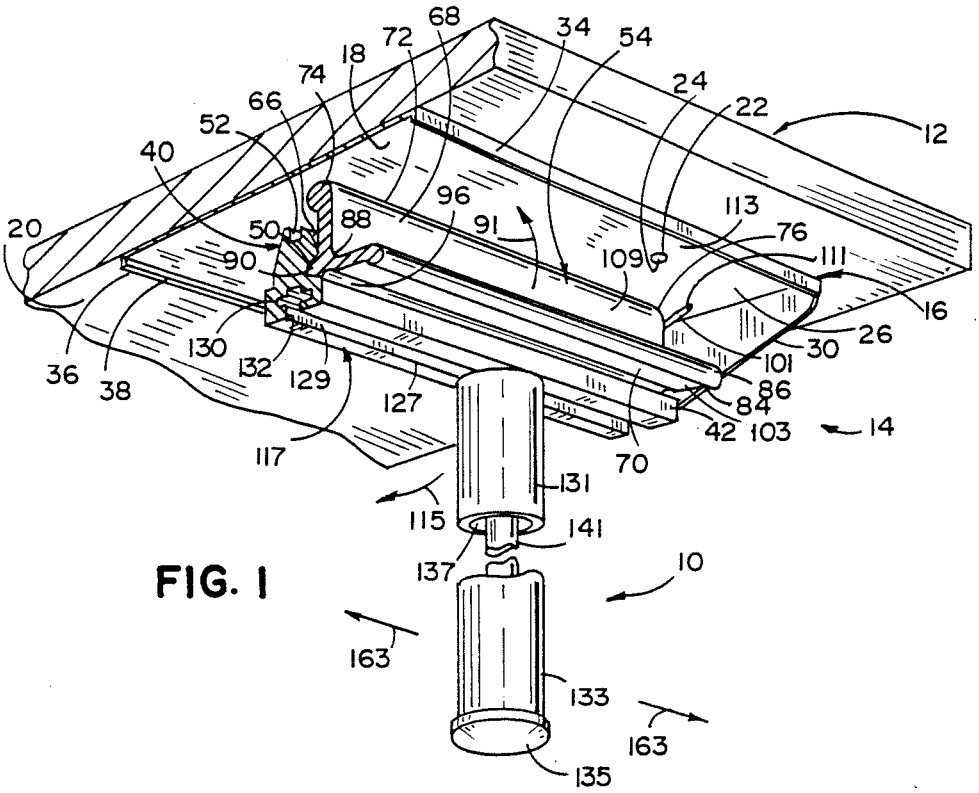
FIG. 1 is a perspective cross-sectional view taken along lines I—I in FIG. 5.
Figure 2:
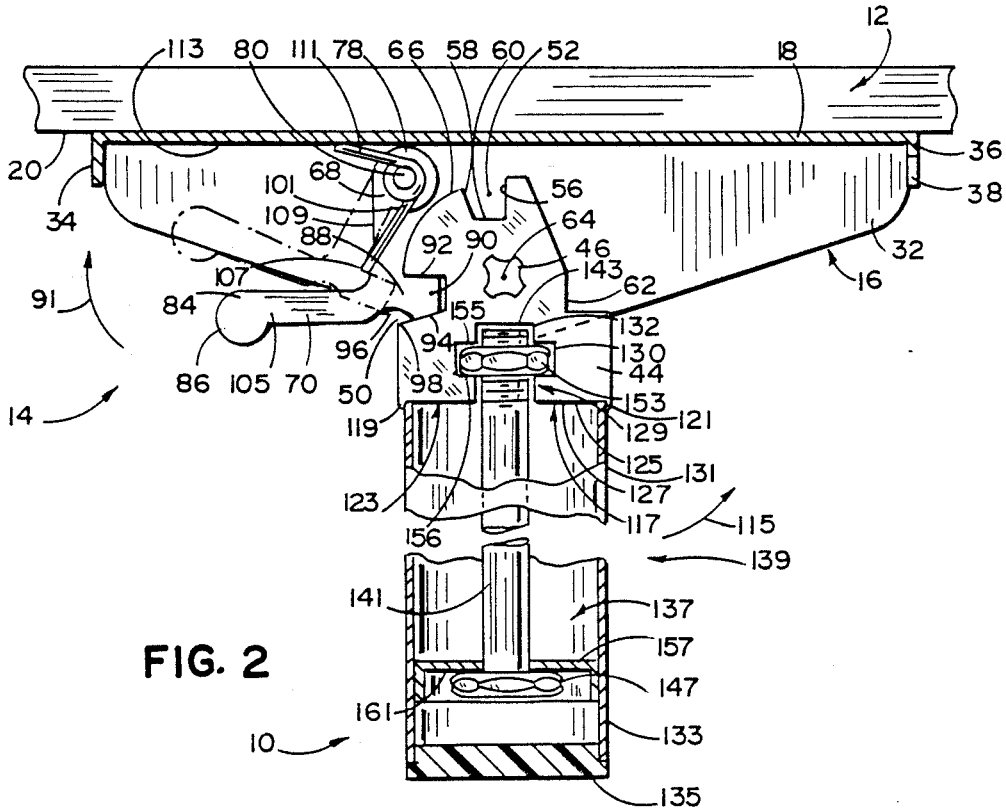
FIG. 2 is a side cross-sectional view taken along lines II—II in FIG. 5.
Figure 5:
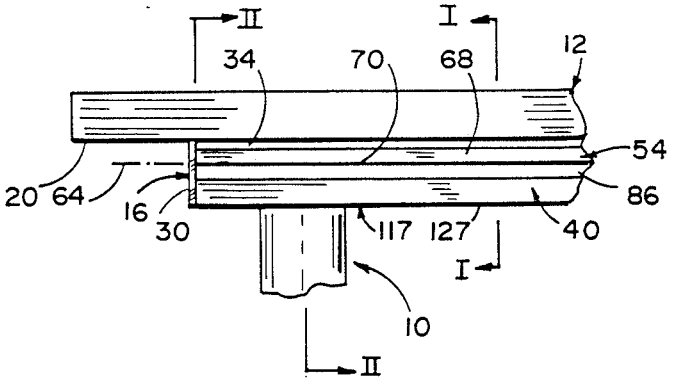
FIG. 5 is a front view of the coupling assembly with the table leg in its extended position.

Coupling assembly 14 includes a base 16 having a generally flat mounting surface 18 mounted in a contiguous relationship with the underside 20 of table top 12. Preferably, mounting surface 18 is provided with a plurality of holes 22 through which screws 24 or other fastening members may be passed to fixedly secure base 16 to the underside of table top 12 (FIG. 1). Along opposite sides 26, 28 of mounting surface 18 are provided a pair of upraised sidewalls 30 which project downwardly when the table is in use (FIGS. 1, 2 and 5). Interconnecting sidewalls 30, 32 are front and rear braces 34, 36. Braces 34, 36 are provided primarily to strengthen and rigidify the projecting sidewalls 30, 32 against unwanted deformation and damage. Rear brace 36 is provided with a cut-out portion 38 extending across most of its length, to accommodate table leg 10 in its collapsed position, as will be discussed below.

Pivotally mounted between sidewalls 30, 32 is a body 40. Body 40 is a generally elongate, extruded member having a pair of opposite ends 42, 44. Each end 42, 44 is provided with an extending stub axle 46 which is received through an opening (not shown) provided in each sidewall 30, 32. Stub axles 46 may be welded to body 40, press fit into a corresponding opening or attached thereto by some other known means. Furthermore, stub axles 46 may be mounted to sidewalls 30, 32 by an appropriate bearing element (not shown).

Figure 3:
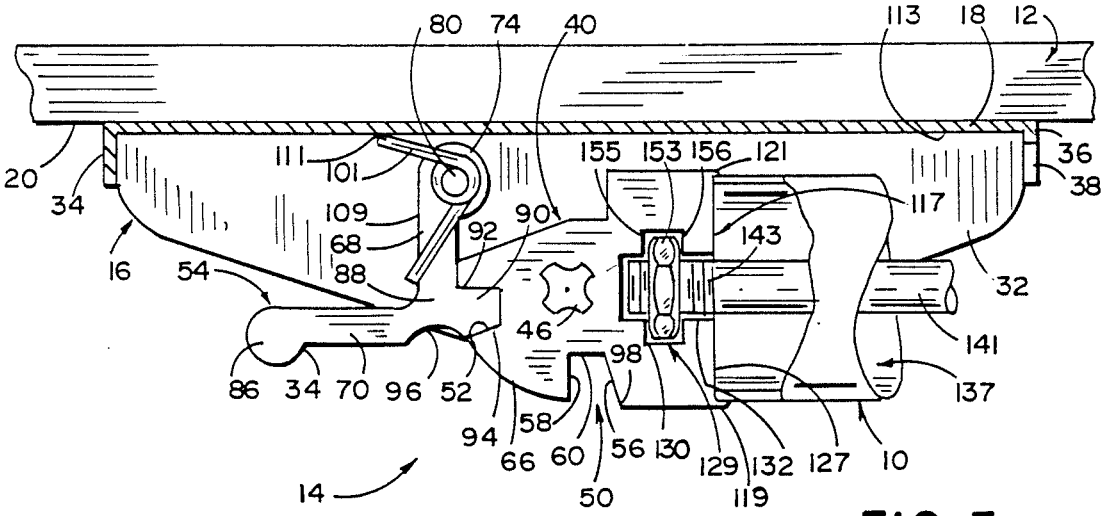
FIG. 3 is a side cross-sectional view with the table leg in its collapsed position.

Body 40 further includes a pair of elongate recesses 50, 52 (FIGS. 1–3). Recesses 50, 52 are angularly spaced from one another approximately 90 degrees so as to cooperate with lever 54 in positioning table leg 10 in its extended, supporting position or its collapsed, storage position as will be discussed below. Each recess 50, 52 is substantially trough-shaped, and is defined by a pair of side surfaces 56, 58 and an interconnecting bight surface 60. First side surfaces 56 of each recess 50, 52 is preferably extended inward at a substantially right angle to the outer peripheral surface 62 of body 40. However, second side surfaces 58 have an inclined configuration which tapers toward the corresponding first side surface 56 as it projects inwardly. The tapering of second side surface 58 facilitates an easy guiding insertion of lever 54 therein and provides a wedging effect to more securely lock lever 54 within one of the recesses 50, 52 to obviate the risk of table leg 10 experiencing any inadvertent collapse or extension.

Figure 4:
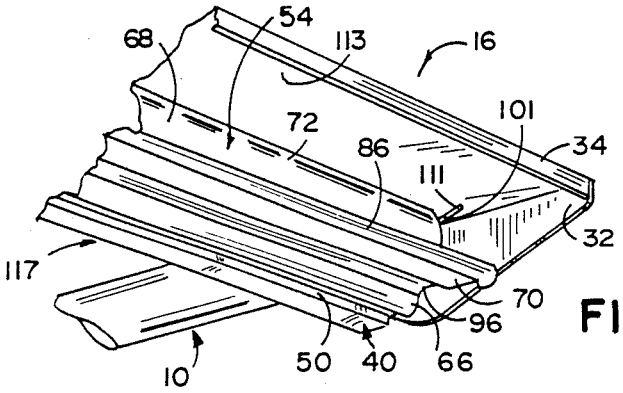
FIG. 4 is a perspective view of the coupling assembly with the table leg in its collapsed position.

To position table leg 10 in its upright extended, supporting position, recess 50 is oriented such that its first side surface 56 is aligned substantially with the pivotal axis 64 of body 40 (FIGS. 1, 2 and 5). In like manner, to ensure that table leg 10 is folded completely against the underside 20 of table top 12, the first side surface 56 of recess 52 is also aligned substantially with the pivotal axis 64 of body 40 (FIGS. 3 and 4). Further, the first side surfaces 56 of each recess 50, 52 are oriented at substantially 90 degrees from one another. Lastly, to ensure a smooth operation between the supporting and collapsed positions, body 40 is provided with an arcuate surface 66 which facilitates a smooth transition for lever 54 when it is being transferred from recess 50 to recess 52 or vice versa.

Lever 54 is preferably also constructed as a generally elongate, extruded member which extends substantially the entire length of body 40 (FIGS. 1, 4 and 5). Lever 54 includes a pair of arms 68, 70 which are interconnected to form a substantially L-shaped configuration (FIGS. 1–3). One arm 68 acts as a supporting arm and is provided at its free end 72 with a boss 74. Boss 74 at each end 76, 78 includes a pivot pin 80 which extends outwardly and is passed through a corresponding aperture (not shown) in sidewalls 30, 32. As with stub axles 46, pivot pins 80 may be welded to boss 74, press fit into a corresponding bore formed therein or attached thereto by other known means. Furthermore, pivot pin 80 may be rotatingly supported by an appropriate bearing element (not shown). The other arm 70 acts as a leverage arm and is provided on its distal end 84 with a knob 86. Knob 86 is designed to provide an easy gripping surface by which the operator may grasp and pivot lever 54 about pivot pin 80 for release thereof from the engaged recess 50 or 52.

Projecting from the apex 88 of lever 54 is a locking dog 90 adapted to cooperate with recesses 50, 52 (FIGS. 1–3). Preferably, locking dog 90 is substantially aligned with leverage arm 70, and is shaped to be matingly received alternatively within recesses 50, 52. Locking dog 90 includes a pair of opposed faces 92, 94, in which first face 92 is oriented to be in substantial alignment with pivot axis 64 of body 40 when dog 90 is received within one of the recesses 50, 52, and second face 94 is oriented at an inclination of approximately 15 degrees to first face 92. As clearly seen in FIGS. 1–3, first face 92 engages first side surface 56 and second face 94 engages second side surface 58 when dog 90 is lockingly received within one of the recesses 50, 52. Directly behind second face 94 is provided a shallow recess 96 which is provided to ensure that no interference will occur between corner 98 of body 40 and lever 54.

A torsion spring 101 is provided to cooperate with lever 54 to thereby bias locking dog 90 into a constant, unwavering receipt into one of the recesses 50, 52 (FIGS. 2 and 3). Preferably, a pair of torsion springs 101 are mounted about each pivot pin 80 along the opposite ends 103, 105 of lever 54. More specifically, one end 107 of torsion spring 101 extends outwardly from pivot pin 80 and wraps around the rear surface 109 of supporting arm 68 and resiliently biases lever 54 toward body 40. The opposite end 111 extends outwardly from pivot pin 80 and presses against downward face 113 of mounting surface 18 in order to provide the requisite resisting force for torsion spring 101.

In operation, then, table leg 10 may be positioned in its extended, supporting position (FIGS. 1, 2 and 5) through the engagement of locking dog 90 into recess 50. T collapse table leg 10 into its storage position (FIGS. 3 and 4), the operator presses leverage arm 70 toward undersurface 20 (in the direction indicated by arrow 91) to pivot lever 54 in a clockwise direction (as shown in phantom in FIG. 2) and thereby release locking dog 90 from recess 50. At this point, the operator may freely pivot table leg 10 in a counterclockwise direction as indicated by arrow 115 (in FIG. 2) so that it closely overlies and parallels underside 20 of table top 12. Once recess 50 has cleared locking dog 90, the operator may release lever 54 so that locking dog 90 rides along arcuate surface 66 as table leg 10 is collapsed. At the end of the table leg's rotation, locking dog 90 when aligned with recess 52 will be automatically biased into locking engagement therewith through the force of torsion spring 101. The operation of moving the leg from its collapsed to its supporting position would be accomplished in the same manner, except that table leg 10 would be rotated in the opposite direction.

Along with providing the pivotal adjustment for table leg 10, coupling assembly 40 also facilitates an infinite lateral adjustment therefor. More specifically, this is accomplished through the provision of an elongate guideway 117 provided along the length of body 40. Guideway 117 is positioned substantially opposite recess 52 so that it extends downwardly when table leg 10 is in its extended, supporting position Guideway 117 includes a pair of upraised lips 119, 121 along its opposite longitudinal sides 123, 125. Extending between lips 119, 121 is an abutment surface 127 which is adapted to engage table leg 10 as will be described below. Centrally positioned in abutment surface 127 is a generally cross-shaped elongate channel 129, defined by intersecting passages 130, 132, which extends substantially along the length of body 40.

Each table leg 10 is of an elongate tubular construction having a preferably circular cross section (although it may be other shapes and even solid materials) and a pair of opposite ends 131, 133. Upper end 131 is adapted to be received between upraised lips 119, 121 and engage abutment surface 127 in a supporting relationship therewith. Lower end 133 is adapted to engage the floor or other supporting surface (not shown) and preferably includes a foot member 135, which could, for example, be composed of a resilient material frictionally held to the lower end 133 of table leg 10. Although other foot arrangements could be used.

Within the cavity 137 of each tubular leg 10 is provided a locking assembly 139 which is adapted to cooperate with channel 129 to secure table leg 10 in any desired position along guideway 117. Locking assembly 139 in the preferred embodiment includes an elongate bolt member 141 positioned axially within leg 10. Bolt member 141 includes a threaded portion 143 at one end and either a conventional head 147 or a second threaded portion adapted to receive a nut at the other end. Threaded portion 143 is received into passage 132 of channel 129 to threadedly mate with a nut 153 oriented laterally thereacross in passage 130. Nut 153 is preferably a steel bar specifically designed to fit the passage and be of a length approximately 25% greater than the width or diameter of leg 10 so as to provide maximum support of leg 10 against guideway 117. In this instance, the bar is drilled and tapped to accept bolt 141. Passage 130 is dimensioned across its width to substantially equal the face-to-face width of nut 153, to thereby preclude any rotation thereof. Further, nut 153 is also matingly received along the depth dimension of passage 130, so that it is held against axial movement by first and second sets of shoulders 155, 156.

Mounted within cavity 137, near the lower end 133 of leg 10, is an inverted cup-shaped stop 157 having a central aperture 159 through which is passed bolt member 141. Stop 157 may be press fit, welded or fixedly secured in any other known fashion. Head or nut 147 is adapted to abut undersurface 161 of stop 157 to provide a complementary resisting force to nut 153 and thereby accomplish the locking of leg 10 into position, as is described below. Alternatively, bolt member 141 may also be positioned oppositely, so that head 147 is received within channel 129 and nut 153 abuts stop 157.

The operation of the lateral adjustment, then, may be accomplished by the operator in a quick and easy manner. Initially, the operator removes foot member 135 to expose head 147. Once foot member 135 is removed, the operator may easily reach head 147 with a suitable socket wrench or the like to effect counterclockwise rotation of bolt member 141. This rotation of bolt member 141 passes it through nut 153 in the direction toward lower end 133 of leg 10. This movement, then, increases the distance between head 147 and nut 153 such that leg 10 is loosely held to guideway 117 to facilitate adjustable movement as indicated by arrows 163 therealong to its newly desired position (FIG. 1). Once this position has been reached, the operator may then rotate head 147 clockwise in order to feed bolt member 141 back through nut 153 and thereby contract head 147 toward nut 153, until head 147 and nut 153 tightly engage undersurface 161 and shoulders 157, respectively.

The cooperating body 40 and lever 54 are each preferably fabricated as an extruded aluminum member, although other fabrication means and materials could be utilized. The use of extrusion members enhances the manufacturing process, by facilitating the mere cutting of the extrusion into the various desired lengths. This construction, then, alleviates the expense of having additional dies or molds for the different sizes needed.

Of course, it is understood that the above are merely preferred embodiments of the invention, and that various other embodiments as well as many changes and alterations may be made without departing from the spirit and broader aspects of the invention as defined in the claims.

The embodiments of the invention in which an exclusive property or privilege is claimed are defined as follows.

1. A table comprising:

a table top having an underside;

at least one table leg for supporting said table top, said table leg having a follow construction and including an stop structure fixedly mounted therein which has a central aperture and an abutment surface facing away from said mounting member;

at least one coupling assembly including an elongated mounting member having a guideway said guideway including an elongate surface adapted to abuttingly engage one end of said leg in the support of said table top, said guideway further including a channel intermediately positioned along said elongated surface, said channel being defined by first and second intersecting passages, wherein said first passage is oriented substantially parallel with said elongated surface; and a locking means operable between said mounting member and said leg for releasably locking said leg to said mounting member to thereby facilitate lateral adjustment of said leg along said underside of said table top, said locking means providing infinite adjustment of said leg along said elongated surface; said locking means including a bolt and a nut, wherein said bolt includes a head and a threaded portion and is passed through said aperture of said top structure to extend axially through said leg, wherein said threaded portion is threadedly received in said nut, and wherein one of said head and nut is positioned within said first passage and the other of said head and nut is positioned adjacent said abutment surface of said stop, such that said head and bolt may be tightened to lock said table leg in a desired position along said guideway and loosened to permit infinite adjustment therealong.

2. The table of claim 1 in which said second passage is oriented substantially perpendicular to said first passage and forms therewith a substantially cross-shaped channel, wherein said first passage receives said nut and thereby precludes rotative and axial movement thereof, and said second passage receives said threaded portion therein.

3. The table of claim 2 in which said mounting member is pivotally mounted to the underside of said table for movement between a pair of positions orienting the leg in either a supporting or collapsed position, and includes a pair of angularly offset recesses; and which further includes a lever having a dog adapted formatting receipt within said recesses so that when said dog is received within one of said recesses said leg is oriented in its supporting position and when received within the other of said recesses said leg is oriented in said collapsed position.

4. The table of claim 3 further including a spring means for biasing said lever toward said leg such that said dog is moved into either of said recesses for locking engagement when aligned therewith.

5. A table comprising:

a table top having an underside;

at least one table leg for supporting said table top;

at least one coupling assembly including an elongated mounting member having a guideway, said mounting member being pivotally mounted to the underside of said table for movement between a pair of positions orienting the leg in either a supporting or collapsed position, and including a pair of angularly offset recesses;

a locking means operable between said mounting member and said leg for releasably locking said leg to said mounting member to thereby facilitate lateral adjustment of said leg along said underside of said table top; and a lever having a dog adapted for mating receipt within said recesses so that when said dog is received within one of said recesses said leg is oriented in its supporting position and when received within the other of said recesses said leg is oriented in said collapsed position.

6. The table of claim 5 further including a spring means for biasing said lever toward said leg such that said dog is moved into either of said recesses for locking engagement when aligned therewith.

7. The table of claim 5 in which said mounting member and said lever are each formed as elongate extruded members.

8. A coupling assembly for movably coupling a table leg for lateral adjustment to the underside of a table top comprising:

an elongated body mounted to the underside of said table, and including an elongated guideway adapted to engage and mount the table leg for supporting of the table top, said guideway having a channel extending longitudinally therealong; and a locking mechanism adapted to cooperate with said channel for releasably locking said leg to said guideway to thereby facilitate lateral adjustment of said leg along said guideway, said locking mechanism includes a bolt having a head and a threaded portion, and a nut threadedly receiving said threaded portion, wherein one of said head and nut is positioned within said channel such that it is precluded from rotative and axial movement, and the other of said head and nut is positioned adjacent and abutment fixedly mounted within the table leg, whereby said head and bolt may be tightened to lock the table leg in a desired position along said guideway and loosened to permit infinite adjustment therealong.

9. The table of claim 8 in which said channel includes first and second intersecting passages wherein said first passage is oriented substantially parallel with said guideway and said second passage is oriented substantially perpendicular to said first passage and forms therewith a substantially cross-shaped channel, wherein said first passage receives said nut to thereby preclude rotative and axial movement thereof, and said second passage receives said threaded portion therein.

10. A coupling assembly for movably coupling a table leg to a table top comprising:

a base attached to the table top;

a body, supporting the table leg, being pivotally mounted to said base for movement between a pair of positions orienting the leg in either a supporting or collapsed position, said body including a pair of angularly offset recesses;

a lever pivotally mounted to said base and having a dog adapted for mating receipt within said recesses so that when said dog is received within one of said recesses said leg is locked in said supporting position and when received within the other of said recesses said leg is locked in said collapsed position; and a spring means for biasing said lever in a direction toward said body, whereby said dog is moved into either of said recesses for locking engagement when aligned therewith.

11. The coupling assembly of claim 10 in which said lever includes a pair of arms interconnected into a substantially L-shaped configuration, wherein said dog comprises an extension of one of said arms from the point of interconnection, wherein the free end of one of said arms includes a pivot pin means for pivotally coupling said lever to said base, and wherein said other arm is adapted for manipulation by a user for releasing said lever from said recesses.

12. The coupling assembly of claim 10 in which each said recess is substantially trough-shaped and is defined by a pair of sidewalls, wherein one of said side walls is aligned with the pivot axis of said body and the other of said sidewalls is oriented at an inclination to the first, and in which said dog includes a pair of opposed faces adapted to matingly engage said pair of sidewalls.

13. The coupling assembly of claim 10 in which said base, said body, said lever and said spring means are all positioned and attached to an underside of the table top so that they are essentially hidden from ordinary observation when said table is in use.

* * * * *

UNITED STATES PATENT AND TRADEMARK OFFICE

CERTIFICATE OF CORRECTION

PATENT NO. : 4,838,181

DATED : June 13, 1989

INVENTOR(S) : Harley E. Luyk

It is certified that error appears in the above-identified patent and that said Letters Patent is hereby corrected as shown below:

Column 4, line 11:
"T" should read -- To --;

Column 5, Claim 1, line 62:
"follow" should read -- hollow --;

Column 6, Claim 1, line 17:
"top" should read -- stop --;

Column 7, Claim 8, line 16:
"supporting" should read -- support --.

Signed and Sealed this

Second Day of April, 1991

*Attest:*

HARRY F. MANBECK, JR.

*Attesting Officer*

*Commissioner of Patents and Trademarks*